United States Patent [19]

Iida et al.

[11] Patent Number: 4,895,114

[45] Date of Patent: Jan. 23, 1990

[54] INTERNAL COMBUSTION ENGINE DRIVEN DEVICE

[75] Inventors: Giichi Iida, Tokyo; Kazunori Takahashi, Kawagoe; Taketomo Kodama, Tokyo, all of Japan

[73] Assignee: Kioritz Corporation, Tokyo, Japan

[21] Appl. No.: 276,036

[22] Filed: Nov. 25, 1988

[30] Foreign Application Priority Data

Dec. 15, 1987 [JP] Japan ..... 62-190447[U]

[51] Int. Cl.[4] ..... F02N 11/08; F02M 1/02

[52] U.S. Cl. ..... 123/179 G; 123/179 C

[58] Field of Search ..... 123/179 G, 179 R, 179 A, 123/179 B, 179 C

[56] References Cited

U.S. PATENT DOCUMENTS 3,774,303 11/1973 Burkett et al. .
4,114,584 9/1978 Rogerson et al. ..... 123/179 G
4,463,723 8/1984 Tansuwan ..... 123/179 G
4,672,929 6/1987 Wissmann et al. ..... 123/179 G
4,768,478 9/1988 Martel ..... 123/179 G

FOREIGN PATENT DOCUMENTS 6379471 5/1988 Japan .

*Primary Examiner*—Willis R. Wolfe
*Assistant Examiner*—M. Macy
*Attorney, Agent, or Firm*—Browdy & Neimark

[57] ABSTRACT

Disclosed is an internal combustion engine driven device having a knob which is operationally linked with a choke valve and is adapted to move the choke valve from the open position to the closed one. Provided on this knob are a movable contact including a contact section formed thereon, and a push-button switch for bringing this movable contact into contact with stationary contacts so as to supply the starter motor with electricity.

2 Claims, 3 Drawing Sheets

INTERNAL COMBUSTION ENGINE DRIVEN DEVICE

BACKGROUND OF THE INVENTION

This invention relates to an internal combustion engine driven device of the type having an internal combustion engine, a choke valve for adjusting the amount of air supplied to the internal combustion engine, a starter motor for starting the internal combustion engine, and a starting switch device for supplying electricity to the starter motor so that it is actuated when the internal combustion engine is started.

When starting, and in particular, cold-starting the internal combustion engine of an internal combustion engine driven device of this type, the operator conventionally first operates a choke valve operating mechanism to bring the choke valve to its closed position. He then supplies electricity to the starter motor by operating the starting switch device to actuate the motor, thereby starting the internal combustion engine.

In this known art, the operator has to separately operate the choke valve mechanism and the starting switch device in order to start the engine. A starting operation is consequently bothersome to the operator. This is particularly the case with an internal combustion engine driven device which is carried by the operator on his back during use. In spite of the fact that the device is equipped with starter motor, it is difficult for the operator to start the internal combustion engine without taking the device off his back.

SUMMARY OF THE INVENTION

This invention accordingly aims at overcoming the above-mentioned problems in the prior art and at providing an internal combustion engine driven device which makes it possible, when cold-starting the engine, to simultaneously effect with a single operation the movement of the choke valve to the closed position and the actuation of the starter motor so as to facilitate the starting of the engine, and, in re-starting the engine, to actuate the starter motor with the then unnecessary choke in the open position.

In accordance with this invention, there is provided an internal combustion engine device of the type described above having a knob operationally linked with a choke valve and adapted to move the choke valve from the open to the closed position, stationary contacts provided in the electric circuit between the starter motor and the power source, a movable contact mounted on said knob and arranged in the vicinity of said stationary contacts, a push-button switch provided on said knob and adapted to bring the movable contact into contact with the stationary contacts such as to supply the starter motor with electricity, and a contact section formed on said movable contact in such a manner as to come into contact with said stationary contacts to supply electricity to the starter motor when said knob is moved from a stationary position corresponding to the open position of the choke valve to an operational position corresponding to the closed position of the choke valve.

When the internal combustion engine is to be cold-started, the operator has only to bring the knob from the stationary to the operational position. This causes the choke valve to be closed, and at the same time, the contact section of the movable contact to come into contact with the stationary contacts, thereby actuating the starter motor. When the starter motor is thus actuated, the internal combustion engine is started. When, on the other hand, no choking is required, which is the case, for example, in warm-starting the engine, and the engine is accordingly started with the choke valve open, the operator can actuate the starter motor and hence start the internal combustion engine, by solely pressing the push-button switch, thereby bringing the movable contact into contact with the stationary contacts. Thus, the operator is able to start the internal combustion engine quickly and easily with a single operation, irrespective of the engine condition.

DETAILED DESCRIPTION OF THE PREFERRED EMBODIMENT

An embodiment of this invention will now be described, with reference to the attached drawings.

Figure 1:
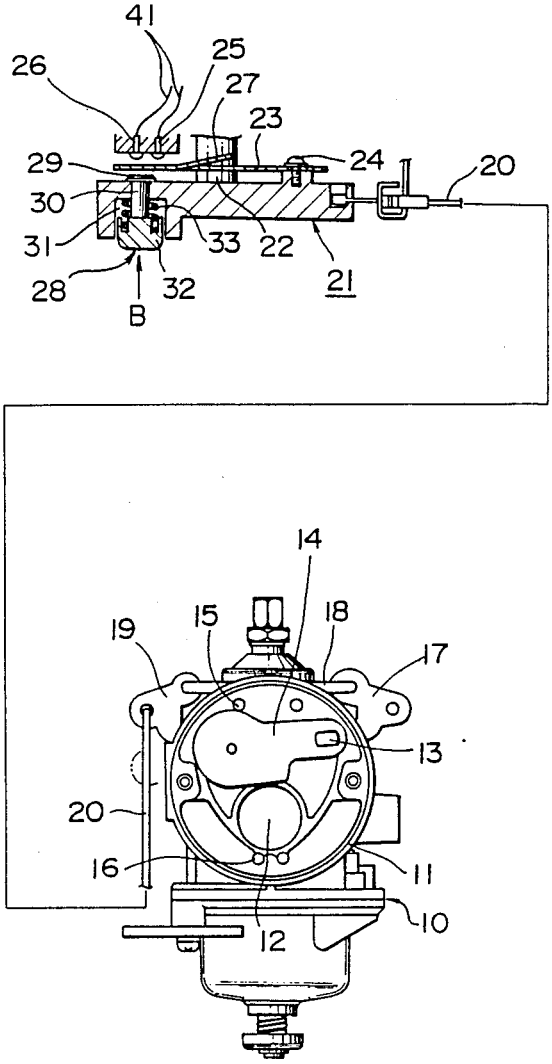
FIG. 1 is a schematic view of the essential parts of an embodiment of this invention.
Figure 2:
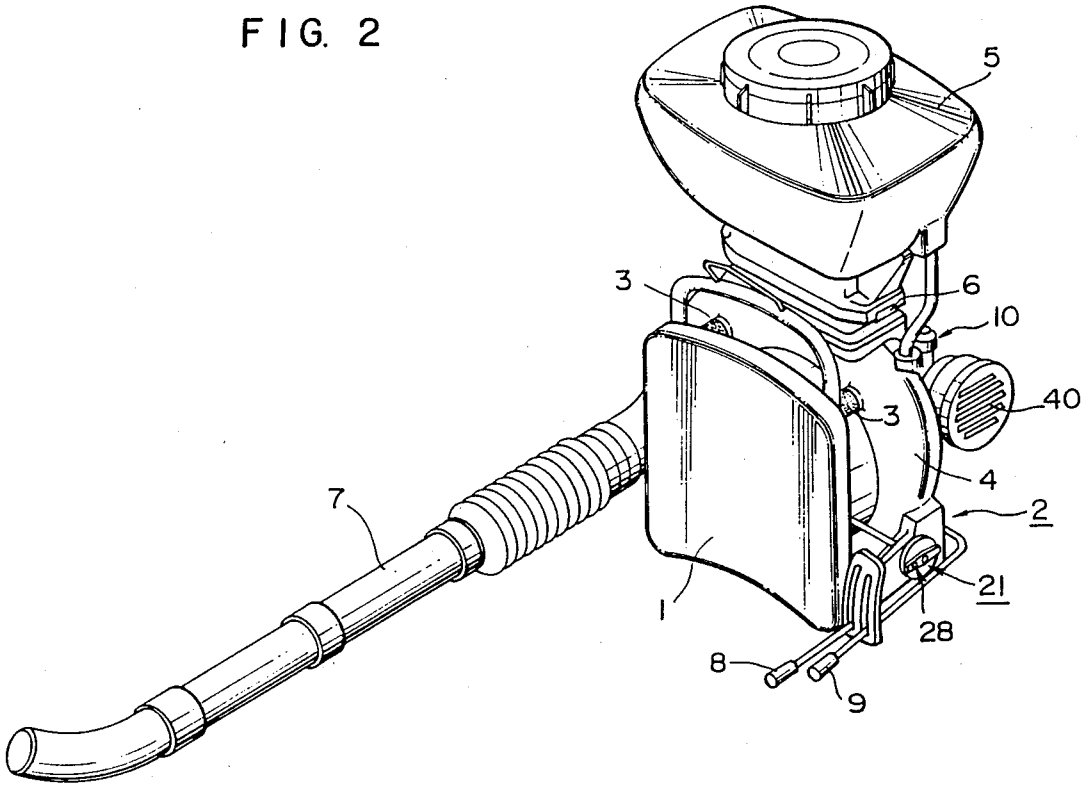
FIG. 2 is a perspective view of a power duster of the type carried on the back of an operator.

In the embodiment shown, the present invention is applied to a power duster of the type which is carried on the back of an operator. As shown in FIG. 2, this power duster includes a carrying frame 1, on which a body 2 is mounted through a plurality of appropriate buffer elements 3. The body 2 includes a fan 4, an internal combustion engine (not shown) provided behind the fan 4 for the purpose of driving the same, a tank 5 provided above the fan 4 and adapted to contain agricultural chemicals or the like to be spread, a metering valve 6 provided between the tank 5 and the fan 4 and adapted to adjust the amount of chemicals or the like to be supplied to the fan 4, a discharge pipe 7 one end of which is connected to the outlet of the fan 4 and through the other end of which the chemicals or the like, mingled with the high-speed air flow from the fan, is spread outwardly, a metering lever 8 provided on a side of the body 2 and adapted to be used for the purpose of controlling the amount of chemicals or the like spread by adjusting the opening of the metering valve 6, and a throttle lever 9 arranged in the vicinity of the metering lever 8 and adapted to control the rotation of the internal combustion engine. The body 2 further includes a carburetor 10 (FIG. 1) for supplying the air-fuel mixture to the internal combustion engine. The elements described so far do not differ from those of ordinary power dusters of the same type which are carried on the back of an operator. A detailed explanation of the structure and operation thereof will accordingly not be given here.

The carburetor 10 includes an inlet 12 formed on the body 11 thereof and adapted to suck ambient air through an air cleaner 40, and a choke valve 14 pivoted on an axis 13 which is rotatably supported by the body 11 and adapted to rotate in a direction crossing the inlet 12. Normally, the choke valve 14 is in the open position shown in FIG. 1 in which the inlet 12 is completely open, biased clockwise (as seen in FIG. 1) by a spring (not shown) around the axis 13, and is held in that position by an open position stopper 15. As will be described later, the choke valve 14 is so arranged that it can be rotated counterclockwise until it abute against a closed position stopper 16, when the inlet 12 is fully closed.

The choke valve 14 can be operated through the choke valve operating mechanism described below. An arm 17 is mounted on the axis 13 of the choke valve 14. The arm 17, which extends perpendicular to the axis 13, can be rotated together with the choke valve 14, and is linked with a lever 19 through a linking member 18. The lever 19 is pivoted on the body 11 of the carburetor 10 in such a manner as to be rotatable in the same plane as the arm 17. One end of a flexible wire 20 is connected to this lever 19. The other end of the wire 20, which is stretched so that it can be moved in the longitudinal direction, is connected to a knob 21.

Figure 3:
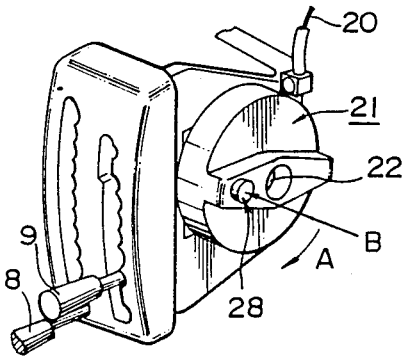
FIG. 3 is a perspective view showing the essential part of FIG. 2.
Figure 4:
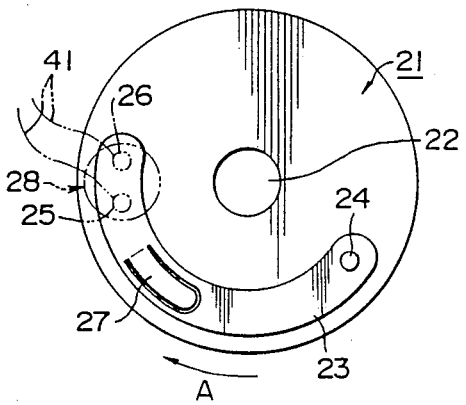
FIG. 4 is an enlarged view illustrating the knob section of this embodiment.

As shown in FIGS. 2 and 3, the knob 21 is arranged on a side of the body 2 in the vicinity of the metering lever 8 and the throttle lever 9 so that the operator may easily handle the knob 21 without taking the duster off his back. The knob 21 has a round, dial-like configuration, and is mounted on the body 2 in such a manner that it can be rotated around its central axis 22. One end of the wire 20 is connected tangentially to the knob 21 at a point on the outer peripheral section thereof. The bias spring of the choke valve 14 holds the knob 21 in its stationary position (FIGS. 1 and 4). When rotated in the direction of arrow A from the stationary position shown in FIG. 3 to the operational position shown in FIG. 5, the knob 21 pulls the wire 20 in the longitudinal direction, thereby rotating the choke valve 14 to the closed position, against the action of the bias spring.

Figure 5:
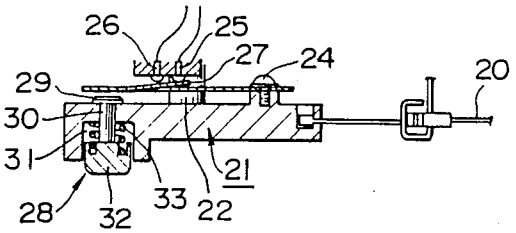
FIG. 5 is a schematic sectional view illustrating the operational condition of the knob section of the embodiment of FIG. 1.

Further, as shown in FIG. 4, one end of a movable arc-like contact 23 which is made of an elastic conductive material is fixed to the inner surface of the knob 23 by means of a screw 24. This movable contact 23 extends along a circular arc around the axis 22, approximately parallel to the inner surface of the knob 21, and can rotate together with the knob 21 around the axis 22. A pair of conductive stationary contacts 25 and 26 spaced apart and insulated from each other are fixed to the body at positions in the proximity of the movable contact 23. These stationary contacts 25 and 26 are so arranged as to be spaced apart from and opposed to the free end of the movable contact 23 when the knob 21 is in its stationary position. The movable contact 23 includes in the middle section thereof a branch 27 which is formed integrally therewith and is bent in the direction of the stationary contacts 25 and 26. When the knob 21 is rotated in the direction of arrow A, i.e. to its closed position, thereby causing the choke valve 14 to close the inlet 12 of the carburetor 10, the branch 27 comes into contact with the stationary contacts 25 and 26 and thereby connects them electrically to each other (FIG. 5). These stationary contacts 25 and 26 are provided in an electric circuit 41 between the starter motor for the internal combustion engine and the power source (not shown). When the stationary contacts 25 and 26 are thus electrically connected to each other by the movable contact 23, the starter motor is supplied with electricity by the power source and is actuated to start the internal combustion engine.

Further, the knob 23 includes a push-button switch 28 at the section opposed to the movable contact 23. This push-button switch 28 includes an axially movable shaft 30 which penetrates through the knob 21 and has an inner large-diameter end 29 situated in the vicinity of the free end of the movable contact 23, a head 32 fixed to the outer end of the shaft 30 and protruding outwardly from a recess 31 formed on the outer surface of the knob 21, and a compression coil spring 33 provided between the knob 21 and the head 32 and adapted to outwardly bias the head 32. When the knob 21 is in its stationary position, pressing the head 32 of the push-button switch 28 in the direction of arrow B in FIG. 1 causes the inner large-diameter end 29 of the shaft 30 to come into contact with the free end of the movable contact 23, thereby biasing it toward the stationary contacts 25 and 26. This results in the movable contact 23 coming into contact with the stationary contacts 25 and 26, thus closing the electric circuit 41. When the operator releases the knob 21 after the internal combustion engine has been started, the choke valve 14 automatically returns to the open position.

When cold-starting the internal combustion engine, the operator turns knob 21 in the direction of arrow A from the stationary position to the operational. This causes the choke valve 14 to move from the open position thereof to the closed one and at the same time the branch 27 of the movable contact 23 is caused to come into contact with the stationary contacts 25 and 26. In other words, the closing of the inlet 12 of the carburetor 10 is effected simultaneously with the actuation of the starter motor. When warm-starting the motor, it is not necessary to operate the choke valve for the purpose of closing the inlet 12 of the carburetor 10. The operator can then depress the push-button switch 28, instead of turning the knob 21. This causes the movable contact 23 to come into contact with the stationary contacts 25 and 26, thereby actuating the starter motor to start the internal combustion engine.

The choke valve 14 may be so arranged that it can be manually returned to the open position after the starting operation of the internal combustion engine has been completed, i.e. when the running of the engine has become steady.

What is claimed is:

1. An internal combustion engine driven device of the type having an internal combustion engine, a choke valve for adjusting the amount of air supplied to the internal combustion engine, a starter motor for starting the internal combustion engine, and a starting switch device for supplying electricity to the starter motor to actuate it when starting the internal combustion engine, comprising: a knob operationally linked with a choke valve and adapted to move the choke valve from the open to the closed position, stationary contacts provided in an electric circuit between the starter motor and a power source, a movable contact mounted on said knob and arranged in the vicinity of said stationary contacts, a push-button switch provided on said knob and adapted to bring the movable contact into contact with the stationary contacts such as to supply the starter motor with electricity, and a contact section formed on said movable contact in such a manner as to come into contact with said stationary contacts to supply electricity to the starter motor when said knob is moved from a stationary position corresponding to the open position of the choke valve to an operational position corresponding to the closed position of the choke valve.

2. An internal combustion engine driven device is claimed in claim 1, wherein said knob has a circular, dial-like configuration and is rotatable around a central axis thereof, an arc-like movable contact being fixed to the inner surface of said knob, said movable contact having in the middle section thereof said contact section which is bent in the direction of said stationary contacts.

* * * * *